United States Patent [19]

Cuthbertson et al.

[11] 4,119,263

[45] Oct. 10, 1978

[54] BOTTOM UNLOADING BULK CONTAINER

[75] Inventors: James P. Cuthbertson, Houston, Tex.; Robert A. Bamburg, Hebert, La.; Farris N. Duncan, West Monroe, La.; Roger M. Floyd, Monroe, La.

[73] Assignee: Olinkraft, Inc., West Monroe, La.

[21] Appl. No.: 820,285

[22] Filed: Jul. 29, 1977

[51] Int. Cl.[2] ..... B65D 5/72; B65D 5/48; B65D 47/10

[52] U.S. Cl. ..... 229/17 B; 229/7 R; 222/528; 214/305; 214/307; 220/403

[58] Field of Search ..... 229/17 B, 17 SC, 7 R, 229/14 R; 222/528, 541; 206/386, 601; 214/304, 305, 307

[56] References Cited

U.S. PATENT DOCUMENTS

| | | | |
|---|---|---|---|
| 2,357,093 | 8/1944 | Mian et al. | 229/7 R X |
| 2,431,786 | 12/1947 | Williamson | 229/17 SC |
| 2,894,666 | 7/1959 | Campbell, Jr. | 222/528 |
| 2,899,119 | 8/1959 | Stowitts et al. | 229/17 SC |
| 3,146,931 | 9/1964 | Neff et al. | 229/7 R |
| 3,207,412 | 9/1965 | Bronte et al. | 214/307 X |
| 3,785,534 | 1/1974 | Smith | 229/17 B X |
| 3,880,341 | 4/1975 | Bamburg et al. | 229/14 BL X |
| 3,904,105 | 9/1975 | Booth | 229/17 SC |
| 3,921,892 | 11/1975 | Macie | 229/17 B |
| 3,972,454 | 8/1976 | Croley | 229/17 B |

*Primary Examiner*—Davis T. Moorhead
*Attorney, Agent, or Firm*—Norvell E. Von Behren

[57] ABSTRACT

A bulk container for bottom unloading having a novel deformable bottom feature. The novel bottom feature comprises a plurality of scorelines being formed on the central portion of the bottom with the scorelines serving to weaken the bottom portion so that it deforms into a generally funnel shape from the weight of the product positioned within the container. The product is then removed from the container through an opening in the deformed bottom with the flow from the container being controlled by a slide plate if flow control is desired by the user of the container.

14 Claims, 12 Drawing Figures

BOTTOM UNLOADING BULK CONTAINER

BACKGROUND OF THE INVENTION

This invention relates generally to bulk material containers and more particularly to a new and novel bottom unloading bulk material container having a unique deformable bottom which aids in unloading the material positioned within the container.

In the packaging of bulk materials such as chemical catalyst products or other materials, it is becoming more and more desirable to package the bulk product in large bulk containers which are capable of handling bulk products weighing in the range of 1300 to 2000 pounds. Such large bulk containers can vary in size from a cube approximately three feet square to an extremely large bulk container that may be 6 or more feet high having a base approximately 4 foot by 4 foot designed to fit on a pallet.

The unloading of bulk containers such as before-mentioned becomes a problem due to the extreme large size of the containers and the weight contained therein and many solutions to the problem of unloading have been attempted with the purpose of being able to quickly unload either the entire contents of the container or a portion of the container contents with means being provided to stop the flow of materials from the container after a given amount has been emptied.

Inasmuch as bottom unloading from these large bulk containers is highly desirable, one commonly utilized type of bottom unloader is typified by the U.S. Pat. No. 3,904,105, issued Sept. 9, 1975, to V. S. Booth and assigned to Olinkraft, Inc., West Monroe, Louisiana. This container utilizes a large two-cell shell structure having a top and bottom cap in combination with a pull plate allowing bottom dumping through a hole contained in the bottom cap of the container. This structure, while satisfactory for the material usually contained in the container, to wit peanuts, would not be satisfactory for many other types of products such as chemical catalysts or other materials where dumping conditions require a better flow from the bottom of the container than can be achieved with this type of a design.

It is known also in bottom dispensing bulk containers to provide a false sloped floor in the bottom portion of the container as typified by the U.S. Pat. No. 2,894,666, issued July 14, 1959 to C. N. Cambell, Jr. for the express purpose of aiding in the flow of the material from the bottom opening in the container. Such false floor, while satisfactory for the given product design, would add greatly to the cost of the container and would require more set-up time for the container, as well as requiring inventory storage of the false floor parts to be placed within the container. It is also known in bottom dumping containers to provide trap-door features in the bottom of the container which are cut open allowing the trap door to swing downwardly so that the product can be dumped from the bottom through the trap door opening. A typical container such as this is shown in the U.S. Pat. No. 3,972,454, issued Aug. 3, 1976, to T. E. Croley and assigned to Comco, Inc., Worthington, Ohio. Containers of this type generally are utilized with a special pallet having an opening in the center portion thereof through which the material can be poured into a receiving bin. It is felt that problems would be encountered in removal of the contents of the product from this type of container and in addition, flow control, if desired, would not be available since the container is designed for entire dumping at one time. In addition, this container would be more costly to manufacture than the applicants' invention and would require much more set-up time for the container as well as requiring special pallets having center holes built into them.

Other known methods of bulk packaging have been utilized such as packaging the material in fiber drums, depending upon the product and application. Such packages generally waste extreme amounts of space in the storage facility prior to dumping and also require excessive time and/or labor to fill, move and store. The unloading of these packages into the user's reactor vessel also generally is a time consuming process which cannot be tolerated in today's fast moving marketplace.

SUMMARY OF THE INVENTION

In order to overcome the problems inherent in the prior art type of devices beforementioned, there has been provided by the subject invention a new and novel bulk package that is extremely rigid and can be easily set up and filled, after which the container could be stacked three high if desired when filled and can be totally emptied with ease from the unique deformable bottom into a receiving funnel of comparable size on top of the receiving vessel. The unique bottom comprises, in the preferred embodiment, a bottom cap being formed with a central portion having a plurality of side panels hingedly connected thereto with the central portion having contained therein a plurality of scorelines which serve to weaken the central portion of the bottom cap so that whenever the container is lifted to a pouring position the weight of the bulk material in the container deforms the central portion into a generally funnel shape. The bulk product then is able to fall or be poured by gravity out through a pouring opening formed in proximity to the plurality of scorelines, thereby achieving a total cleanout of the bulk product from the container upon dumping which eliminates sweeping a given quantity of remaining product out of the dumping hole after the natural gravity flow ceases, which is the prior art practice required with most bottom dumping containers.

The unique bottom for the applicant's container is rigidly locked to the container shell, as will be described more fully hereinafter, and when flow control is desired in dumping the containers, there has been provided a unique slide plate positioned over the dumping opening which may be quickly and easily moved over the opening to provide off and on control of the dumping should it be desired to dump only a portion of the container. The applicant's unique bulk material container may be utilized for storage and dumping of chemical catalysts which are packaged inside the container in an inner poly bag with the entire container being positioned within an outer poly bag and heat shrunk to a bottom inner poly sheet thereby making the package extremely moisture resistant until it is desired to empty the contents from the container.

By utilization of a lifting frame, the subject new and novel container with its outer poly bag may be positioned upon a pallet and the lifting frame utilized to remove the package from the pallet for dumping in a dumping receptacle.

Accordingly, it is an object and advantage of the invention to provide an improved bottom dumping container having a unique deformable bottom which automatically deforms from the weight of the product contained in the container Whenever the container is lifted to a dumping position. Another object and advantage of the invention is to provide an improved container having a deformable bottom where the deformable bottom serves as a funnel to funnel the bulk contents out of the container thereby eliminating manual removal of a portion of the contents after gravity flow ceases.

Still yet another object and advantage of the invention is to provide an improved bulk material container comprising a shell portion and a top and bottom cap positioned on the shell portion with the bottom cap being uniquely locked to the shell portion and the entire container being utilized to handle a chemical catalyst or other material.

Still yet another object and advantage of the invention is to provide a unique bulk bottom pouring container having a deformable bottom and having a flow control sliding plate positioned therein which may be easily moved in and out of the container to provide easy flow control without jamming or binding of the sliding plate.

These and other objects and advantages of the invention will become apparent from a study of the drawings showing the preferred embodiment and from a review of the description of the preferred embodiment hereinafter.

DESCRIPTION OF THE PREFERRED EMBODIMENT

Figure 1:
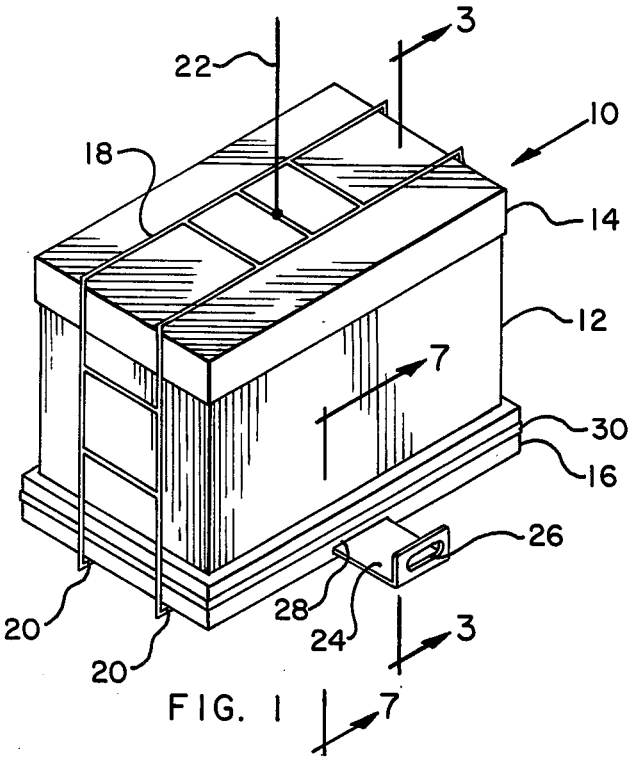
FIG. 1 is a perspective view showing the improved bulk material container of the subject invention.
Figure 11:
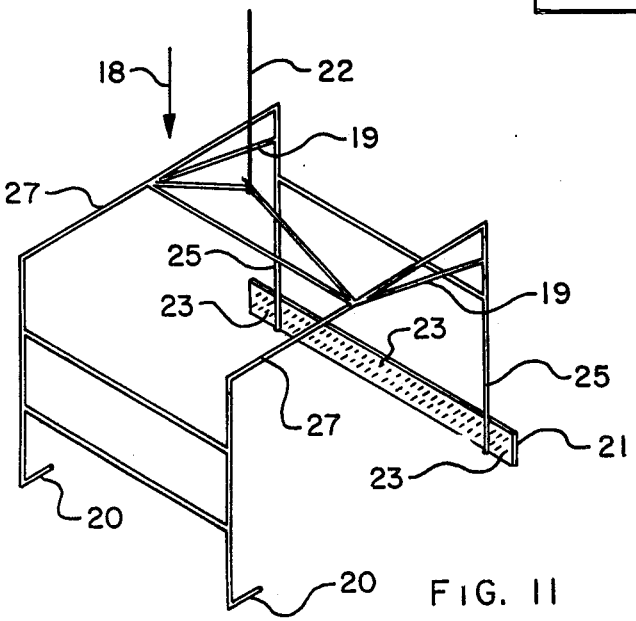
FIG. 11 is a perspective view of a modification of the lifting frame.

Referring now to the drawings in general and in particular to FIG. 1 of the drawing, there is shown the subject improved bulk material container, generally by the numeral 10, which comprises a central shell portion 12 having a top cap 14 positioned on the upper portion thereof, and a bottom cap 16 positioned on the lower portion. The bulk material container 10 is designed to be lifted by a separate lifting frame 18 having a plurality of lifting fingers 20 projecting underneath the bottom of the container. The lifting frame 18 is attached to a rope 22, steel cable, or other means which then may be raised and lowered as desired to position the bulk material container in a given pouring position. A modified lifting frame is shown in FIG. 11 and its use will be described more fully hereinafter.

When it is desired to control the flow of material from the container, a sliding plate 24 having a hand hold 26 is positioned within a slot 28 formed in the bottom cap 16, as will be described more fully hereinafter. The bottom cap 16 is tightly restrained on the central shell 12 by means of a steel band 30 as well as by an interlocking feature locking the bottom cap 16 to the central shell 12 as will be more fully described hereinafter when referring to FIG. 3 of the drawing.

Figure 2:
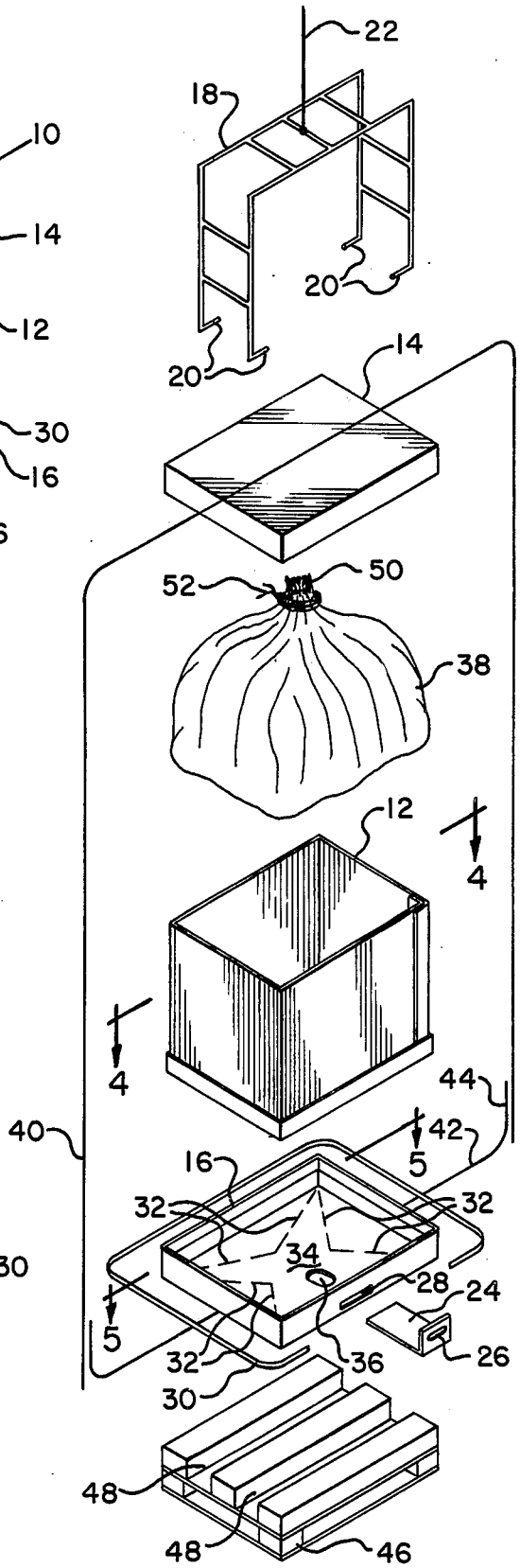
FIG. 2 is an exploded perspective view showing the container of FIG. 1 with its associated lifting frame and pallet.

Referring now to FIG. 2 of the drawing there is shown an exploded perspective view of the subject bulk material container shown in FIG. 1 of the drawing showing the respective parts of the subject invention in somewhat more detail. The bottom cap 16 has formed in the bottom thereof a plurality of scorelines 32 forming a star pattern 34 in the bottom of the bottom cap 16, as will be described more fully hereinafter. Also formed in the bottom of the bottom cap 16 is a pouring opening 36 in proximity to the plurality of scorelines 32 and in the central portion of the star pattern 34 from which the quantity of materials packaged in the container in the polyethylene bag 38 may be removed. The entire bulk material container 10 is also contained within an outer polyethylene bag 40 which is placed over the top cap 14 and the central shell 12 containing the inner poly bag 38 and also over the bottom cap 16 and the sliding plate 24. An inner poly sheet 42 is also positioned underneath the bottom cap 16 with its ends 44 being positioned within the outer poly bag 40 in the preferred embodiment. Prior to shipping of the bulk material container 10, the entire combination is then passed through a heat shrink tunnel in order to heat shrink the outer poly bag 40 tightly over the bulk material container 10 and also to heat shrink the inner poly sheet 42 so that its ends 44 adhere to the outer poly bag 40, thereby forming a tight moisture resistant covering over the entire package.

The entire package is placed for shipment on a special wooden pallet 46 having slots 48 sized to allow the lifting fingers 20 of the lifting frame 18 to be positioned within the slots beneath the bottom cap 16 in order to lift the entire package as shown in FIG. 1 of the drawings. By referring to FIG. 11, there is shown a modification of the lifting frame 18 wherein a plurality of lifting fingers 20 project underneath the bottom of the container 10 on one side with an opposing horizontal strip 21 having a plurality of barbs 23 to prevent relative downward movement of the bulk material container 10 within the frame 18. The horizontal strip 21 is affixed to vertical pivoting legs 25 which are connected by rods 19 to the lifting component 27 of the frame in such a manner as to cause the act of lifting to press the horizontal strip 21 against the container 10 with a force proportional to the weight of the container and its contents.

The frame 18 is then suspended by its lifting component 27 at an angle which is equivalent to the angle of repose of the catalyst or other material carried in the container 10. The frame 18 must be placed around the container 10 so that the horizontal strip 21 is oriented to be on the side of the container 10 which is closest to the pouring opening in the bottom of the container.

The outer polyethylene bag 40, in the preferred embodiment, may be approximately 6 mils thick while the inner polyethylene sheet 42 may be approximately 4 mils thick. By the use of the polyethylene bag 40 and sheet 42 of the size mentioned, a six sided moisture and dust protection is given to the entire package and its contents container within the inner poly bag 38. The inner poly bag 38 may be spot glued to the inside of the central shell 12 during production of the shell and may have its ends 50 tied with a twist type metal wire 52 or the ends 50 may be left loose and simply folded on top of the bulk product as desired by the customer.

Figure 3:
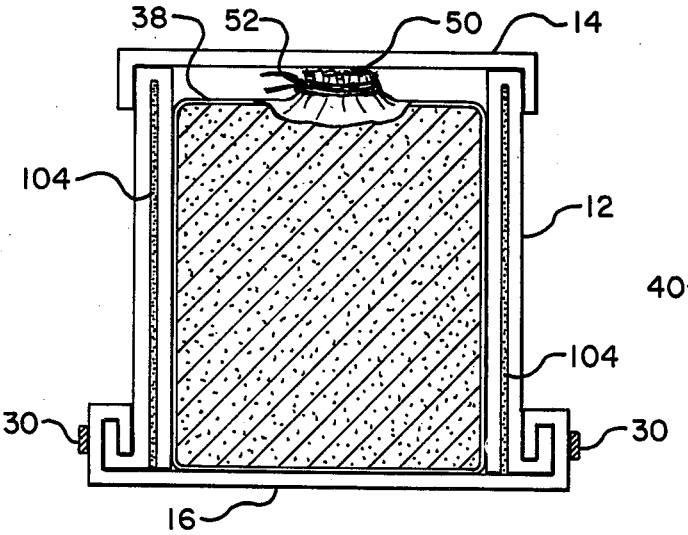
FIG. 3 is a cross sectional view, taken along line 3—3 of FIG. 1, showing the bulk container having an inner poly bag containing the bulk product and also showing the unique locking of the bottom cap to the shell structure.
Figure 10:
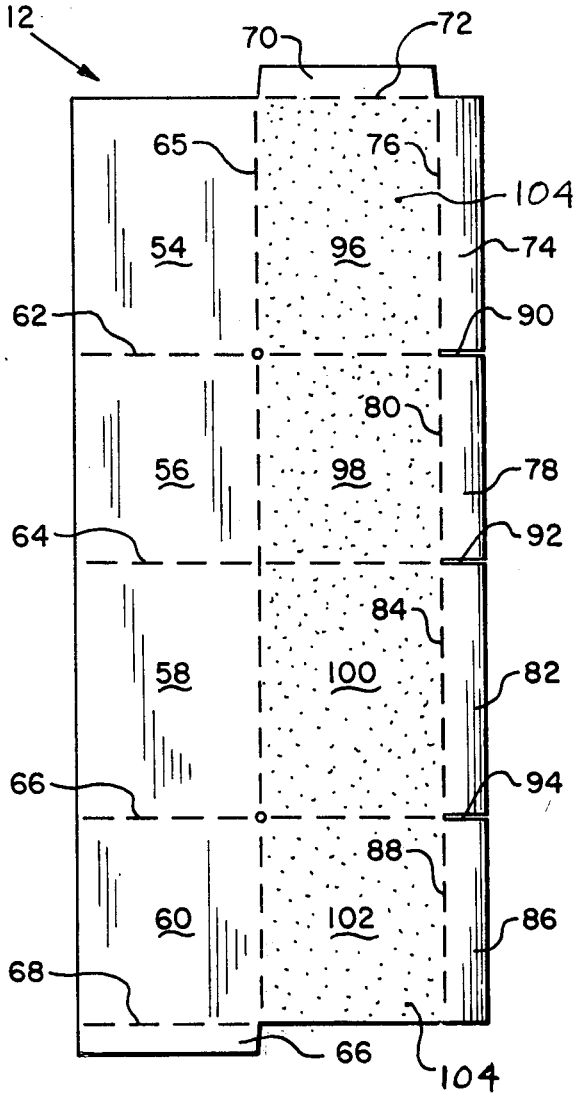
FIG. 10 is a plan view of the production blank for the shell utilized with the subject preferred embodiment.

Referring now more particularly to FIGS. 10 and 3 of the drawing, there will be described in detail the construction of the central shell 12 which comprises a series of rectangular panels 54, 56, 58 and 60 hingedly attached together by a plurality of scorelines 62, 64 and 66. The panels 54, 56, 58 and 60 are divided in the middle by an elongated scoreline 65 which runs the length of the panels 54, 56, 58 and 60.

Formed on one end of panel 60 is a manufactures joint flap 66 by means of the scoreline 68 and formed on the opposite end of the production blank on panel 54, in the position shown in FIG. 10, is a manufactures joint flap 70 hingedly attached to the panel 54 by means of the scoreline 72. Formed on the panel 54 on one side thereof is a side panel 74 by means of the scoreline 76 and in a like manner there is formed a side panel 78 on the panel 56 by means of the scoreline 80. Panel 58 has formed on its side a side panel 82 by means of the scoreline 84 and panel 60 has formed on its side a side panel 86 by means of the scoreline 88. The respective side panels 74, 78, 82 and 86 are separated from each other by means of the slots 90, 92 and 94.

When formed in the manner just described the central shell 12 also has applied thereto an adhesive in the area 96 between the scorelines 62, 72, 65 and 76 and in a like manner the adhesive is applied to the area 98 formed between the scorelines 65, 80, 62 and 64. The area 100 formed between the scorelines 64, 66, 65 and 84 also has applied thereto an adhesive which is also applied to the area 102 formed between the scorelines 66, 65, and 88.

Figure 4:
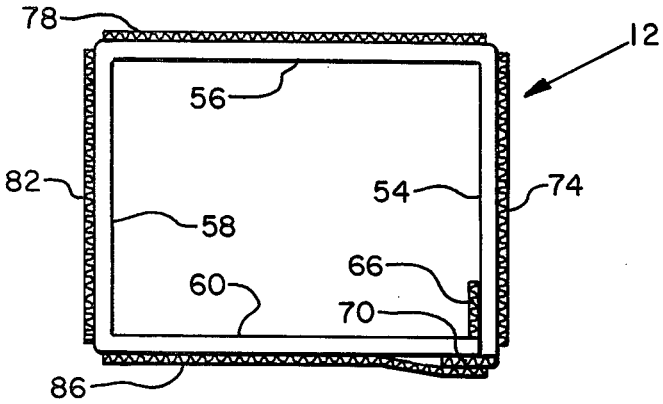
FIG. 4 is a view, taken along line 4—4 of FIG. 2, showing the double manufactures joint utilized in formation of the shell structure and locking the respective panels together.

By referring now to FIGS. 3 and 4 of the drawing as well as FIG. 10, it can be seen how the central shell 12 is formed to provide a double wall shell which has adhesive 104 applied between the respective panels as before mentioned. In erecting the central shell 12, the panels 54, 56, 58 and 60, as well as the manufactures joint 66 are folded along the elongated scoreline 65 so that one half of the panel 54 is laminated to the area 96 with one half of the panel 56 being laminated to the area 98. In a similar manner one half of the panel 58 is laminated to the area 100 while one half of the panel 60 is laminated to the area 102.

Figure 8:
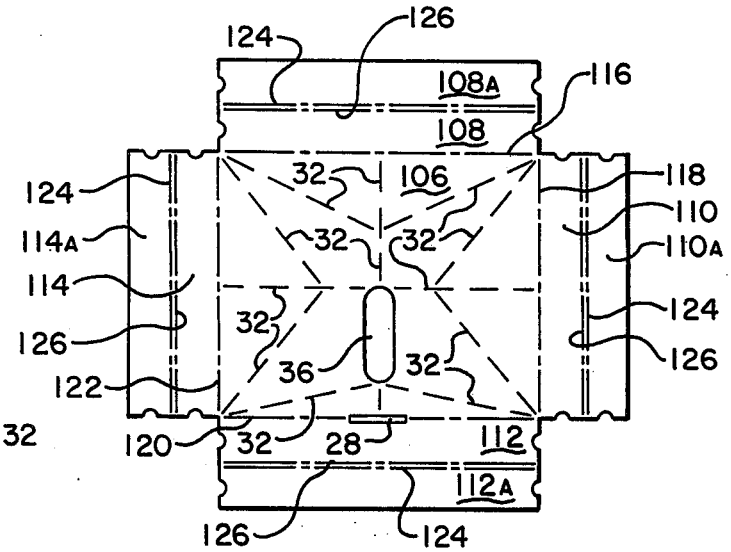
FIG. 8 is a plan view of the production blank for the bottom cap utilized with the preferred embodiment.

Referring now to FIG. 4 of the drawing there will be seen how the manufactures joint is constructed for the subject central shell 12 which comprises positioning the manufactures joint flap 66 against the panel 54 and positioning the manufactures joint flap 70 against the panel 60 with both being adhesively attached to their panels or stapled in place by means well known in the art. When formed thusly, it can be seen how the central shell 12 becomes a rigid double wall shell which is also clearly seen by referring to FIG. 3 of the drawings. Referring now to FIG. 8 of the drawing there is seen a plan view of the production blank for the bottom cap 16 which comprises a central panel 106 having a plurality of side panels 108, 110, 112 and 114 hingedly attached thereto by means of the scorelines 116, 118, 120 and 122. The side panels 108, 110, 112 and 114 have formed therein in the central portion a pair of scorelines 124 and 126 dividing the respective panels in half to form outer panels **108*a*, 110*a*, 112*a*, and 114*a***.

By referring now particularly to FIG. 3 of the drawing and also to FIG. 8 it will be seen how the bottom cap 16 is interlocked with the shell 12 by the use of the side panels 108, 110, 112 and 114 in combination with the outer panels **108*a*, 110*a*, 112*a* and 114*a*. The outer panels 108*a*, 110*a*, 112*a* and 114*a* are positioned between the side panels 74, 78, 82 and 86 which had previously been folded outward from the shell and turned upwardly so that the outer panels 108*a*, 110*a*, 112*a* and 114*a* can be turned downwardly between the upwardly turned side panels and the shell proper. When positioned in this manner as shown in FIG. 3 of the drawing there is then applied the steel or plastic band 30 which is tightly positioned around the shell structure thereby allowing the bottom cap or bottom of the container to be able to support great amounts of weight from the bulk materials contained within in the inner poly bag 38**.

Figure 5:
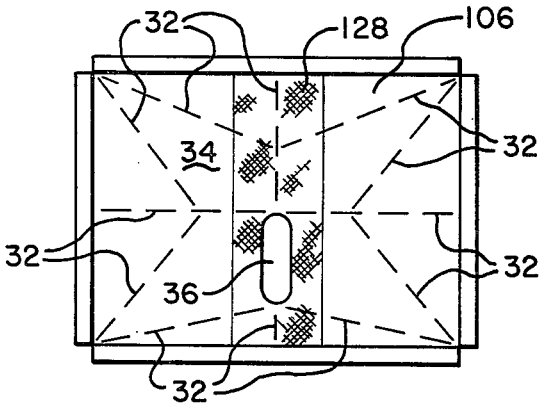
FIG. 5 is a plan view, taken along line 5—5 of FIG. 2, showing the unique bottom structure of the bottom cap of the preferred embodiment.
Figure 12:
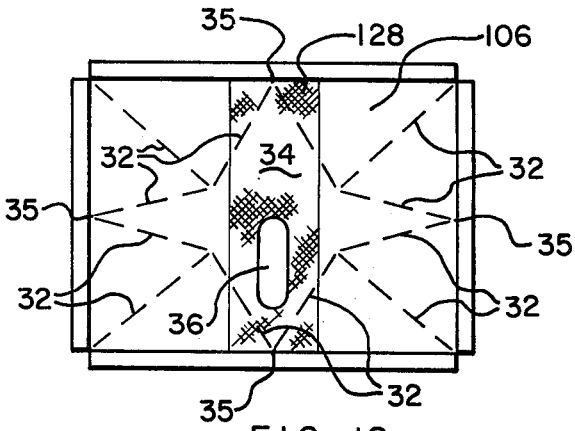
FIG. 12 is a plan view similar to FIG. 5 showing a modification of the score line placement.

Referring now to FIG. 5 of the drawing there is shown a view taken along line 5—5 of FIG. 2 of the bottom cap showing the plurality of scorelines 32 formed in the central panel 106 of the bottom cap 16. As before mentioned, the plurality of scorelines 32 are formed in a star pattern 34 which also contains the pouring opening 36 which is formed in a generally elongated configuration in the preferred embodiment but may be formed circular or in some other configuration with the spirit and scope of the invention. The pouring opening 36 is formed off center within the star pattern 34 in the preferred embodiment and may also be centrally located therein. The star pattern is formed in the preferred embodiment with the star points positioned in the corners of the central panel 106. It is within the spirit and scope of the invention that some or all of the star points may be positioned at locations other than the corners of the central panel 106. For example by referring to FIG. 12 there is shown a modification of FIG. 5 wherein the score lines 32 are placed in a star pattern also but have their points 35 located at other than the corners of the central panel 106.

Figure 6:
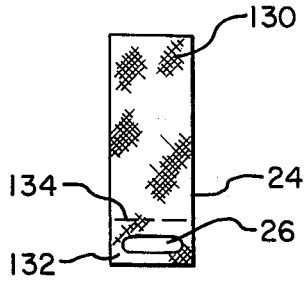
FIG. 6 is a plan view of the slide plate used to control flow in the subject invention.

There is applied a friction diminishing coating in the form of a silicone coating 128 which is applied across the central panel 106 and the star pattern 34 at least as wide as the pouring opening 36 and preferably somewhat wider. The purpose of the friction diminishing silicone coating 128 is to reduce the friction between the sliding plate 24 and the central panel 106 as the sliding plate is moved on the central panel. The sliding plate 24 may also have applied thereto a silicone coating 130 as shown in FIG. 6 of the drawing and the slide plate may be formed out of hard fiberboard or some other material as desired by the purchaser or supplied by the manufacturer. The slide plate 24 is sized to fit within the slot 28 formed on the central panel 106 as shown in FIG. 8 of the drawing and contains the hole 26 formed in the panel 132 hingedly attached to the slide plate by means of the scoreline 134.

Figure 7:
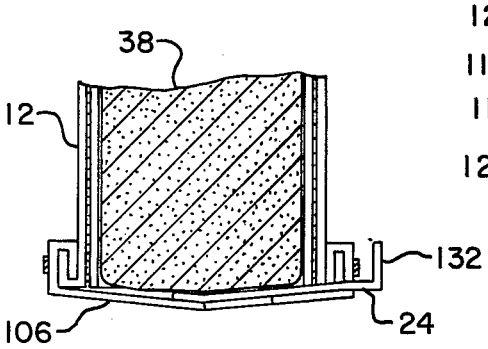
FIG. 7 is an enlarged sectional view, taken along line 7—7 of FIG. 1, showing the unique bottom structure of the subject invention and how the bottom structure is deformable by the weight of the product contained in the package to form the generally funnel shaped bottom.

Referring now to FIG. 7 of the drawing there is shown in greater detail how the star pattern 34 and its respective scorelines 32 allow the central panel 106 of the bottom cap 16 to be weakened thereby deforming from the weight of the product positioned on the bottom cap in the inner poly bag 38. Since the central shell 12 as well as the top cap 14 and the bottom cap 16 are formed out of corrugated paperboard in the preferred embodiment it can be seen by referring to FIG. 7 that whenever a scoreline 32 is placed in the central panel 106 the structural integrity of the corrugated paperboard will be weakened because of the diminished thickness in the paper thereby allowing the bottom to deform to the position shown in FIG. 7 to provide a generally funnel shaped bottom which serves as an aid in guiding the material out of the container. Whenever the slide plate 24 is positioned in the container as shown in FIG. 7 of the drawing the silicone coating 130 on the slide plate 24 will come in contact with the silicone coating 128 on the central panel 106 allowing the pull plate 24 to be easily moved in and out of the container according to the desires of the operator.

Figure 9:
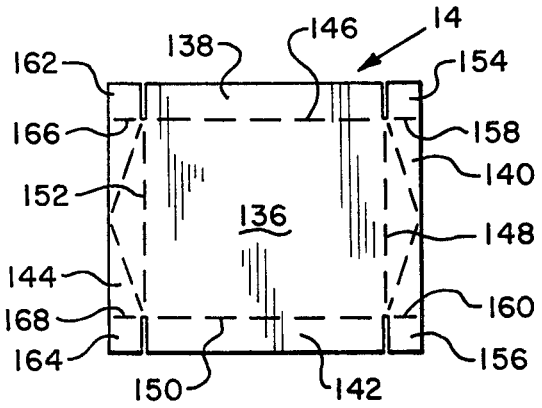
FIG. 9 is a plan view of the production blank for the top cap utilized with the preferred embodiment.

Referring now to FIG. 9 of the drawings there is shown in detail the top cap 14 of the subject invention which comprises generally a central panel 136 having formed thereon a plurality of side panels 138, 140, 142 and 144 by means of the scorelines 146, 148, 150 and 152. The side panel 140 has formed on each end thereof a flap 154 and a flap 156 by means of the scorelines 158 and 160. In a like manner the side panel 144 has formed on the side thereof a flap 162 and a flap 164 by means of the scorelines 166 and 168. When erecting the top cap 14, the side panels 138, 140, 142 and 144 are folded 90 degrees about their respective scorelines 146, 148, 150 and 152. Thereafter the flaps 154 and 156 are turned inwardly about their respective scorelines 158 and 160 and are stapled or glued to their adjacent side panels 138 or 142. In a like manner the flaps 162 and 164 are turned inwardly about their respective scorelines 166 and 168 and are stapled or glued to their respective side panels 138 or 142.

From the above it can be seen that there has been provided by the subject invention a new and improved bulk material container which is designed to handle a large quantity of bulk materials such as chemical catalysts or other bulk materials and which has new and improved features which allow the bulk materials to be quickly and easily removed from the container by bottom dumping as a result of the deformable bottom formed in the container. Whenever the subject container is lifted from the pallet 46 by means of the lifting frame 18, the weight of the bulk materials contained in the inner poly bag 38 will exert a downward force on the bottom cap 16 and especially the central panel 106 deforming the central panel so that the star pattern 34 formed by the scorelines 32 forms a funnel for channeling the bulk materials out through the pouring opening 36 whenever the sliding plate 24 has been extracted by pulling it outwardly through its associated slot 28. As a result the subject new and improved bulk material container may be partially dumped in a controlled manner by utilizing the sliding plate 24 and may be totally dumped without requiring an extra operation to manually remove a quantity of the bulk materials that generally remain in a prior art type of container. Depending upon the weight of the material contained within the inner poly bag 38, it may be necessary to slit the inner poly bag 38, as well as the inner poly sheet 42, with a knife or some sharp object if the weight of the bulk material is not sufficient to tear the sheets away whenever the sliding plate 24 is removed from the face of the pouring opening 36.

It can be seen that there has been provided by the subject invention a new and unique container which accomplishes all of the objects and advantages of the invention and it should be apparent that many changes can be made in the various structural parts and arrangement of parts in the subject invention without departing from the spirit and scope of the invention and the preferred embodiment, given by way of illustration only, is not to limit the invention's scope.

Having described our invention, we claim:

1. In a bottom for a bulk shipping and storage container of the type wherein a mass of bulk product is contained in the container with its weight resting on the bottom, the improvement comprising:

(a) the bottom being formed with a central portion having a plurality of side panels hingedly connected thereto;

(b) a plurality of score lines being formed on said central portion for weakening said central portion so that said portion deforms from the weight of the product positioned on the bottom into a generally funnel shape; and (c) a pouring opening formed in proximity to said plurality of score lines for removing the bulk product from the container.

2. The improvement as defined in claim 1 wherein said plurality of score lines are formed in a star pattern and said pouring opening is formed in the central portion of the star pattern.

3. The improvement as defined in claim 1 wherein said central portion has applied thereto a friction diminishing coating across the central portion at least as wide as said slot.

4. The improvement as defined in claim 1 wherein said pouring opening is oval shaped.

5. The improvement as defined in claim 2 wherein said pouring opening is formed off center within said star pattern.

6. The improvement as defined in claim 2 wherein said star pattern comprises a four point star having a star point at each corner of said central portion.

7. The improvement as defined in claim 2 wherein said star pattern is formed having at least one star point located at a corner of said central panel.

8. An improved bulk material container designed for bottom pouring from the container, comprising:

(a) a central shell portion having an upper and a lower opening;

(b) a top cap positioned on the upper opening of said shell portion;

(c) a bottom cap positioned on the lower opening of said shell portion, said bottom cap comprising:

(1) the bottom cap being formed with a central portion having a plurality of side panels hingedly connected thereto;

(2) a plurality of score lines being formed on said central portion for weakening said central portion so that said portion deforms from the weight of the product positioned on the cap into a generally funnel shape;

(3) a pouring opening formed in proximity to said plurality of score lines for removing the bulk product from the container;

(4) a slot being formed in proximity to the hinged connection of one of the side panels and in proximity to said pouring opening, said slot being sized somewhat larger than said pouring opening; and (d) an elongated slide plate positioned in said slot and partially within said container and partially outside of said container and covering said pouring opening.

9. The container as defined in claim 8, wherein said central portion has applied thereto a friction diminishing coating across the central portion at least as wide as said slot.

10. The container as defined in claim 8 wherein said slide plate has applied thereto a friction diminishing coating on the side facing said pouring opening.

11. The container as defined in claim 8 wherein said central portion and one side of said slide plate have applied thereto in facing engagement a friction diminishing coating.

12. The container as defined in claim 8 further comprising said container having positioned therein a plastic bag for receiving the contents of the container, said plastic bag being spot glued to at least two sides of said central shell.

13. An improved moisture resistant package comprising a container and contents designed for bottom pouring from the container, comprising:

(a) a central shell portion having an upper and a lower opening;

(b) a top cap positioned on the upper opening of said shell portion;

(c) a bottom cap positioned on the lower opening of said shell portion, said bottom cap comprising:

(1) the bottom cap being formed with a central portion having a plurality of side panels hingedly connected thereto;

(2) a plurality of score lines being formed on said central portion for weakening said central portion so that said portion deforms from the weight of the product positioned on the cap into a generally funnel shape;

(3) a pouring opening formed in proximity to said plurality of score lines for removing the bulk product from the container; and (4) a slot being formed in proximity to the hinged connection of one of the side panels and in proximity to said pouring opening, said slot being sized somewhat larger than said pouring opening;

(d) an elongated slide plate positioned in said slot and partially within said container and partially outside of said container and covering said pouring opening;

(e) an inner plastic bag positioned within said central shell portion for receiving the contents of the container;

(f) a heat shrinkable outer plastic bag positioned over said top cap, said central shell portion, said bottom cap, and said slide plate; and (g) a heat shrinkable plastic sheet positioned beneath said bottom cap, said plastic sheet and said outer plastic bag being heat shrunk to a tight moisture resistant fit with the ends of said plastic sheet being positioned within said plastic bag prior to heat shrinking so that upon heat shrinking the ends are adhered to said bag.

14. The improvement as defined in claim 2 wherein said star pattern is formed having the star points located at positions on the edges of the central panel other than at the central panel corners.

* * * * *